US010434553B2

(12) United States Patent
Robbins

(10) Patent No.: US 10,434,553 B2
(45) Date of Patent: Oct. 8, 2019

(54) EXTRUSION PRESS CONTAINER AND MANTLE FOR SAME, AND METHOD

(71) Applicant: Exco Technologies Limited, Markham (CA)

(72) Inventor: Paul Henry Robbins, Port Perry (CA)

(73) Assignee: Exco Technologies Limited, Ontario (CA)

( * ) Notice: Subject to any disclaimer, the term of this patent is extended or adjusted under 35 U.S.C. 154(b) by 491 days.

(21) Appl. No.: 14/923,892

(22) Filed: Oct. 27, 2015

(65) Prior Publication Data

US 2016/0114367 A1 Apr. 28, 2016

Related U.S. Application Data

(60) Provisional application No. 62/068,959, filed on Oct. 27, 2014.

(51) Int. Cl.

| | |
|---|---|
| ***B21C 27/00*** | (2006.01) |
| ***B21C 29/02*** | (2006.01) |
| ***B21C 31/00*** | (2006.01) |

(52) U.S. Cl.

CPC ..... *B21C 27/00* (2013.01); *B21C 29/02* (2013.01); *B21C 31/00* (2013.01)

(58) Field of Classification Search

CPC ..... B21C 29/00; B21C 29/02; B21C 29/04; B21C 27/00; B21C 23/21; B21C 23/212; B21C 23/215; B21C 31/00

See application file for complete search history.

(56) References Cited

U.S. PATENT DOCUMENTS

| | | | | |
|---|---|---|---|---|
| 3,042,195 A * | 7/1962 | Muller | B21C 29/02 | 72/272 |
| 3,360,975 A * | 1/1968 | Edgecombe | B21C 29/02 | 72/272 |
| 4,882,104 A * | 11/1989 | Dobrowsky | B29C 47/0023 | 264/209.1 |
| 7,594,419 B2 * | 9/2009 | Robbins | B21C 27/00 | 72/272 |
| 2014/0174143 A1 * | 6/2014 | Robbins | B21C 27/00 | 72/272 |

FOREIGN PATENT DOCUMENTS

| | | | | |
|---|---|---|---|---|
| DE | 4242395 A1 * | 6/1994 | ..... | B21C 29/02 |
| EP | 0481951 A2 * | 4/1992 | ..... | B21C 27/00 |

OTHER PUBLICATIONS

Translation of EP 0481951 A2, Phoenix Translations, Mar. 2016.*

* cited by examiner

*Primary Examiner* — Pradeep C Battula
(74) *Attorney, Agent, or Firm* — Young Basile Hanlon & MacFarlane, P.C.

(57) ABSTRACT

A container for use in a metal extrusion press includes a mantle having an elongate axial bore therein, the bore having a first transverse axis orthogonal to a second transverse axis, and a plurality of longitudinally extending heating elements accommodated by the mantle adjacent the bore. The heating elements are individually controllable for controlling a thermal profile within the container. The container also includes a plurality of temperature sensors configured to measure the thermal profile within the container. The temperature sensors include a first temperature sensor and a second temperature sensor positioned on opposite sides of the first transverse axis, and a third temperature sensor and a fourth temperature sensor positioned on opposite sides of the second transverse axis.

18 Claims, 8 Drawing Sheets

EXTRUSION PRESS CONTAINER AND MANTLE FOR SAME, AND METHOD

CROSS REFERENCE TO RELATED APPLICATION

This application claims benefit of U.S. Provisional Patent Application No. 62/068,959, filed Oct. 27, 2015.

BACKGROUND

The present invention relates generally to extrusion and in particular, to an extrusion press container and mantle for same and method.

Metal extrusion presses are well known in the art, and are used for forming extruded metal products having cross-sectional shapes that generally conform to the shape of the extrusion dies used. A typical metal extrusion press comprises a generally cylindrical container having an outer mantle and an inner tubular liner. The container serves as a temperature controlled enclosure for a billet during extrusion. An extrusion ram is positioned adjacent one end of the container. The end of the extrusion ram abuts a dummy block, which in turn abuts the billet allowing the billet to be advanced through the container. An extrusion die is positioned adjacent the opposite end of the container.

During operation, once the billet is heated to a desired extrusion temperature (typically 800-900° F. for aluminum), it is delivered to the extrusion press. The extrusion ram is then activated to abut the dummy block thereby advancing the billet into the container and towards the extrusion die. Under the pressure exerted by the advancing extrusion ram and dummy block, the billet is extruded through the profile provided in the extrusion die until all or most of the billet material is pushed out of the container, resulting in the extruded product.

In order to attain cost-saving efficiency and productivity in metal extrusion technologies, it is important to achieve thermal alignment of the extrusion press. Thermal alignment is generally defined as the control and maintenance of desired running temperature of the various extrusion press components. Achieving thermal alignment during production of extruded product ensures that the flow of the extrudable material is uniform, and enables the extrusion press operator to press at a higher speed with less waste.

As will be appreciated, desired billet temperature can only be maintained if the container can immediately correct any change in the liner temperature during the extrusion process, when and where it occurs. Often all that is required is the addition of relatively small amounts of heat to areas that are deficient.

A number of factors may be considered when assessing the thermal alignment of an extrusion press. For example, the whole of the billet of extrudable material may be at the optimum operating temperature in order to assure uniform flow rates over the cross-sectional area of the billet. The temperature of the liner in the container may also serve to maintain, and not interfere with, the temperature profile of the billet passing therethrough.

Achieving thermal alignment is generally a challenge to an extrusion press operator. During extrusion, the top of the container usually becomes hotter than the bottom. Although conduction is the principal method of heat transfer within the container, radiant heat lost from the bottom surface of the container rises inside the container housing, leading to an increase in temperature at the top. As the front and rear ends of the container are generally exposed, they will lose more heat than the center section of the container. This may result in the center section of the container being hotter than the ends. As well, the temperature at the extrusion die end of the container tends to be slightly higher compared to the ram end, as the billet heats it for a longer period of time. Additionally, one side of the container may be hotter than the other. These temperature variations in the container affect the temperature profile of the liner contained therein, which in turn affects the temperature of the billet of extrudable material. The temperature profile of the extrusion die generally conforms to the temperature profile of the liner, and the temperature of the extrusion die affects the flow rate of extrudable material therethrough. Although the average flow rate of extrudable material through the extrusion die is governed by the speed of the ram, flow rates from hotter sections of the billet will be faster compared to cooler sections of the billet. The run-out variance across the cross-sectional profile of a billet can be as great as 1% for every 5° C. difference in temperature. This can adversely affect the shape of the profile of the extruded product. Control of the temperature profiles of the liner and of the container is therefore of great importance to the efficient operation of the extrusion process.

It is therefore an object at least to provide a novel extrusion press container and mantle for same and method.

SUMMARY

In one aspect, there is provided a container for use in a metal extrusion press, the container comprising: a mantle having an elongate axial bore therein, the bore having a first transverse axis orthogonal to a second transverse axis, and a plurality of longitudinally extending heating elements accommodated by the mantle adjacent the bore, the heating elements being individually controllable for controlling a thermal profile within the container; and a plurality of temperature sensors configured to measure the thermal profile within the container, the temperature sensors comprising: a first temperature sensor and a second temperature sensor positioned on opposite sides of the first transverse axis, and a third temperature sensor and a fourth temperature sensor positioned on opposite sides of the second transverse axis.

The container may further comprise a liner accommodated within the bore, the liner comprising an elongate body having a longitudinally extending passage therein through which a billet is advanced. The heating elements may be arranged circumferentially about the axial bore of the mantle. The first, second, third and fourth temperature sensors may be positioned adjacent a die end of the container. The first and second temperature sensors may be configured to measure a vertical thermal profile within the container, and the third and fourth temperature sensors may be configured to measure a horizontal thermal profile within the container. At least one of the temperature sensors may be within the mantle. At least one of the temperature sensors may be within the liner. The temperature sensors may be thermocouples. At least one of the heating elements may comprise at least one heating section. Each of the heating elements may comprise two heating sections positioned towards each relative end thereof.

In another aspect, there is provided a mantle for a container for use in a metal extrusion press, the mantle having: an elongate axial bore, the bore having a first transverse axis orthogonal to a second transverse axis; a plurality of longitudinally extending bores formed adjacent the axial bore and configured to accommodate heating elements; and a plurality of temperature sensor bores configured to accommodate temperature sensors, the temperature sensor bores comprising: a first temperature sensor bore and a second temperature sensor bore formed on opposite sides of the first transverse axis, and a third temperature sensor bore and a fourth temperature sensor bore formed on opposite sides of the second transverse axis.

The mantle may further comprise heating elements accommodated in said longitudinally extending bores, wherein the heating elements are individually controllable for controlling the thermal profile within the container. The may further comprise temperature sensors accommodated within the temperature sensor bores, wherein the temperature sensors are configured to measure the thermal profile within the container. The mantle may be configured to accommodate a liner within the axial bore, the liner comprising an elongate body having a longitudinally extending passage therein through which a billet is advanced. The bores may be configured to accommodate the heating elements are formed circumferentially about the axial bore. The first, second, third and fourth temperature sensor bores may be formed adjacent a die end of the mantle. The first and second temperature sensor bores may be positioned to allow measurement of a vertical thermal profile within the container, and the third and fourth temperature sensor bores may be positioned to allow measurement of a horizontal thermal profile within the container. The first, second, third and fourth temperature sensor bores may terminate within the mantle. At least one of the first, second, third and fourth temperature sensor bores may extend from the mantle into the liner.

In another aspect, there is provided a method of controlling a thermal profile within a metal extrusion press container, the container comprising a mantle having an elongate axial bore therein, the bore having a first transverse axis orthogonal to a second transverse axis, the method comprising: measuring the thermal profile within the container using a first temperature sensor and a second temperature sensor positioned on opposite sides of the first transverse axis, and a third temperature sensor and a fourth temperature sensor positioned on opposite sides of the second transverse axis; and controlling the thermal profile in the container using a plurality of longitudinally extending heating elements accommodated by the mantle adjacent the bore.

The heating elements may be individually controllable for controlling the thermal profile. Measuring the thermal profile may comprise: measuring a vertical thermal profile within the container using the first and second temperature sensors, and measuring a horizontal thermal profile within the container using the third and fourth temperature sensors. The mantle may accommodate a liner within the bore, the liner comprising an elongate body having a longitudinally extending passage therein through which a billet is advanced. The heating elements may be arranged circumferentially about the axial bore of the mantle. The first, second, third and fourth temperature sensors may be positioned adjacent a die end of the container. At least one of the temperature sensors is within the mantle. At least one of the temperature sensors may be within the liner. The temperature sensors may be thermocouples. At least one of the heating elements may comprise at least one heating section. Each of the heating elements may comprise two heating sections positioned towards each relative end thereof.

BRIEF DESCRIPTION OF THE DRAWINGS

Embodiments will now be described more fully with reference to the accompanying drawings in which.

DETAILED DESCRIPTION

Figure 1:
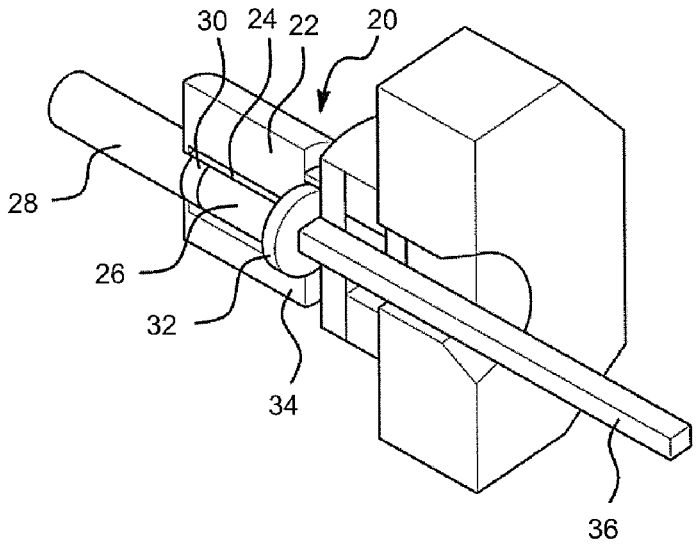
FIG. 1 is a schematic perspective view of a metal extrusion press.
Figure 2:
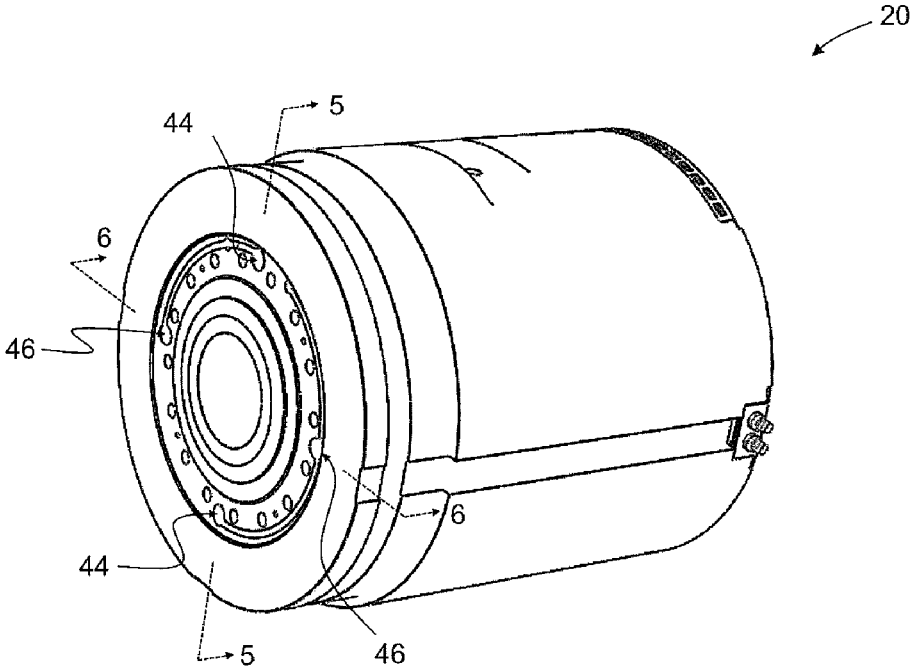
FIG. 2 is a perspective view of a container forming part of the metal extrusion press of FIG. 1.

FIG. 1 is a simplified illustration of an extrusion press for use in metal extrusion. The extrusion press comprises a container 20 having an outer mantle 22 that surrounds an inner tubular liner 24. The container 20 serves as a temperature controlled enclosure for a billet 26 during extrusion of the billet. An extrusion ram 28 is positioned adjacent one end of the container 20. The end of the extrusion ram 28 abuts a dummy block 30, which in turn abuts the billet 26 allowing the billet to be advanced through the container 20. An extrusion die 32 is positioned adjacent a die end 34 of the container 20.

During operation, once the billet 26 is heated to a desired extrusion temperature (typically 800-900° F. for aluminum), it is delivered to the extrusion press. The extrusion ram 28 is then actuated to abut the dummy block 30, thereby to advance the billet 26 into the container and towards the extrusion die 32. Under the pressure exerted by the advancing extrusion ram 28 and dummy block 30, the billet 26 is extruded through the profile provided in the extrusion die 32 until all or most of the billet material is pushed out of the container 20, resulting in the extruded product 36.

Figure 3:
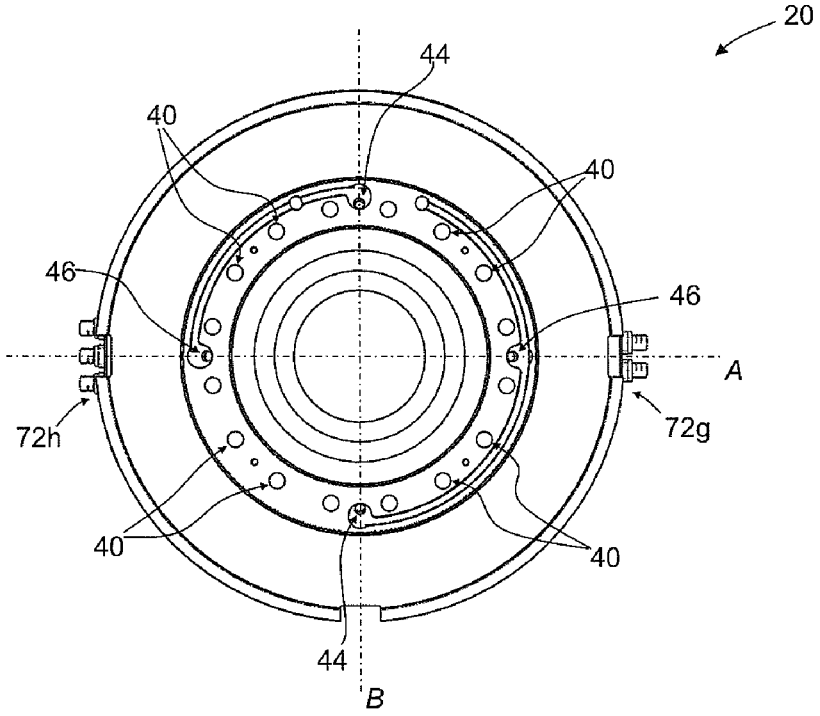
FIG. 3 is a front view of the container of FIG. 2.
Figure 4:
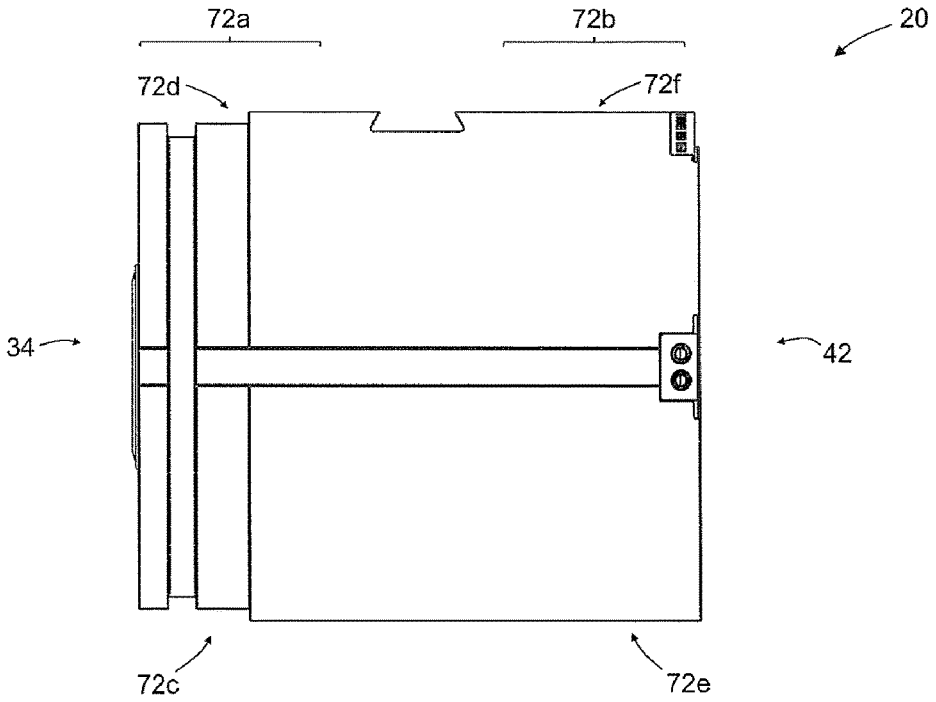
FIG. 4 is a side view of the container of FIG. 2.
Figure 5:
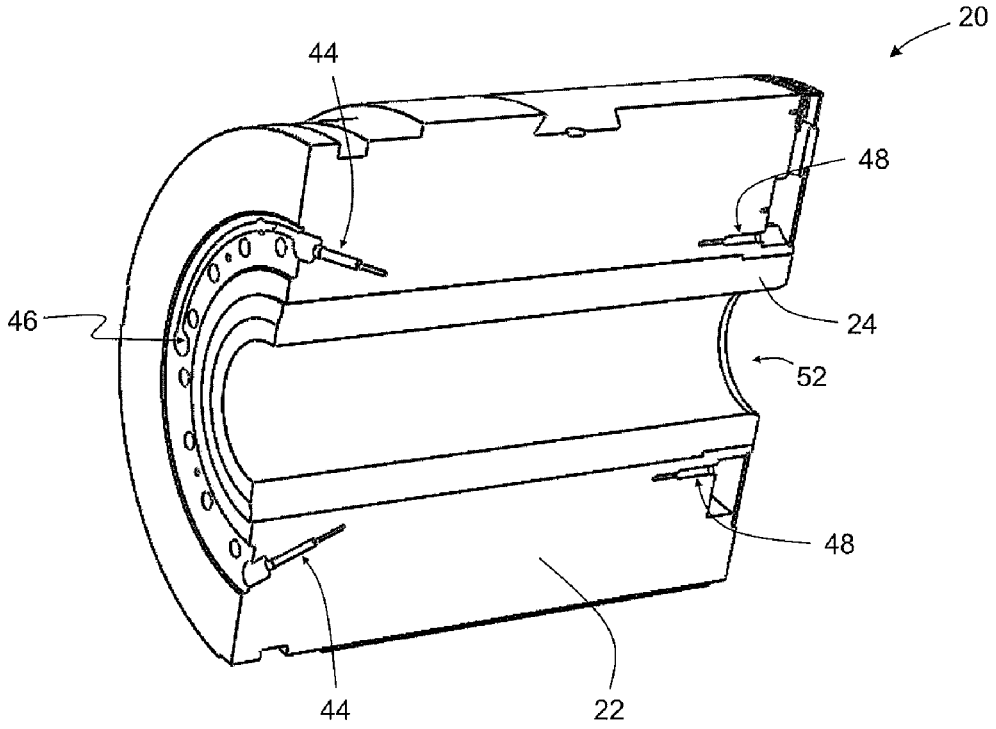
FIGS. 5 and 6 are sectional views of the container of FIG. 2, taken along the indicated section lines.
Figure 6:
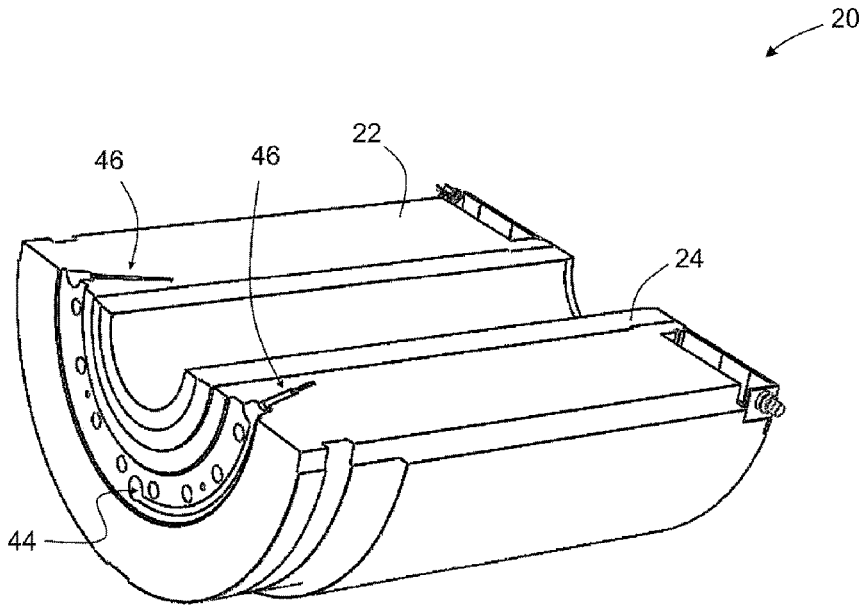

The container 20 may be better seen in FIGS. 2 to 7. The container 20 is configured at the die end 34, and along the side sections thereof, in a manner known in the art to facilitate coupling of the container 20 to the extrusion press. The mantle 22 has an elongate shape and comprises an elongate axial bore accommodating the liner 24. In this embodiment, the mantle 22 and the liner 24 are shrunk-fit together. The elongate axial bore has a first transverse axis A and a second transverse axis B, with the first and second transverse axes A and B being orthogonal, as shown in FIG. 3.

The mantle 22 also comprises a plurality of longitudinal bores 40 extending from the die end 34 of the mantle 22 to the ram end 42 of the mantle 22, and surrounding the liner 24. Each longitudinal bore 40 is shaped to accommodate an elongate heating element, described further below, that can be energized to provide thermal energy to the mantle 22 in the vicinity of the liner 24 during use. The number of longitudinal bores 40 needed depends on the size of the container 20 and on the voltage used to energize the elongate heating elements. In this embodiment, the mantle comprises sixteen (16) longitudinal bores 40. The container 20 is configured to have an end cover plate installed (not shown) on its die end 34 that covers the ends of the longitudinal bores 40.

The mantle 22 further comprises a plurality of bores 44, 46 and 48 adjacent the liner 24 and extending partially into the length of the mantle 22. In this embodiment, the mantle 22 comprises two (2) bores 44 extending from the die end 34 approximately four (4) inches into the mantle 22, two (2) bores 46 extending from the die end 34 approximately four (4) inches into the mantle 22, and two (2) bores 48 extending from the ram end 42 approximately four (4) inches into the mantle 22. Each bore 44, 46 and 48 is shaped to accommodate a temperature sensor (not shown). The bores 44, 46 and 48 are positioned in a manner so as to avoid intersecting any of the longitudinal bores 40 configured to accommodate the heating elements. The bores 44 are positioned on opposite sides of the first transverse axis A, and the bores 46 are positioned on opposite sides of the second transverse axis B, and the bores 46 are positioned on opposite sides of the second transverse axis B. In this embodiment, the container 20 is oriented such that one (1) of the bores 44 is positioned above the liner 24 while the other bore 44 is positioned below the liner 24, one (1) of the bores 46 is positioned on the right side of the liner 24 while the other bore 46 is positioned on the left side of the liner 24, and one (1) of the bores 48 is positioned above the liner 24 while the other bore 48 is positioned below the liner 24.

The liner 24 comprises a billet receiving passage 52 that extends longitudinally therethrough and, in the embodiment shown, the passage 52 has a generally circular cross-sectional profile.

Figure 7:
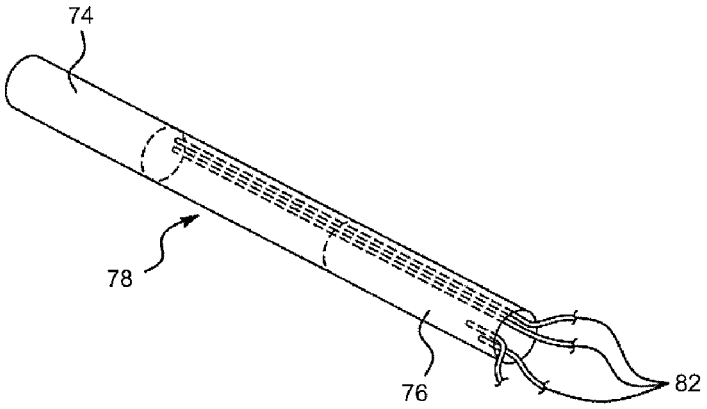
FIG. 7 is a perspective view of a heating element for use with the container of FIG. 2.

FIG. 7 shows one of the elongate heating elements for use with the container 20, and which is generally indicated by reference numeral 70. Heating element 70 is a cartridge-type element. The regions of the container in greatest need of added temperature are generally the die end 34 and ram end 42, referred to as die end zone 72*a* and ram end zone 72*b*, respectively. As such, each heating element 70 may be configured with segmented heating regions. In this embodiment, and as shown in FIG. 7, each heating element 70 is configured with a die end heating section 74 and a ram end heating section 76, which are separated by a central unheated section 78. To energize and control the heating elements, lead lines 82 feed to each heating section 74, 76. The lead lines connect to various bus lines (not shown), which in turn connect to a controller (not shown). The arrangement of the bus lines may take any suitable configuration, depending on the heating requirements of the container 20. In this embodiment, the bus lines are configured to selectively allow heating of the die end zone 72*a* and ram end zone 72*b* of the container, or more preferably just portions thereof, as deemed necessary by the operator. In this embodiment, the arrangement of lead lines enables each of the heating elements 70 to be individually controllable, and also enables each of the heating sections 74, 76 within each heating element 70 to be individually controllable. For example, the operator may routinely identify temperature deficiencies in a lower die end zone 72*c* and a lower ram end zone 72*e*. The elongate heating elements 70 in the vicinity of the lower die end zone 72*c* and the lower ram end zone 72*e* are configured to be controlled by the operator to provide added temperature when required. Similarly, the elongate heating elements 70 in the vicinity of an upper die end zone 72*d* and an upper ram end zone 72*f* are configured to be controlled by the operator to provide reduced temperature when required. Additionally, the elongate heating elements 70 in the vicinity of any of a right die end zone 72*g* and a right ram end zone (not shown), and a left die end zone 72*h* and a left ram end zone (not shown), are configured to be controlled by the operator to provide either added or reduced temperature when required. It will also be appreciated that the operator can selectively heat zones so as to maintain a preselected billet temperature profile. For example, the operator may choose a billet temperature profile in which the temperature of the billet progressively increases towards the die end, but with a constant temperature profile across the cross-sectional area of the billet. This configuration is generally referred to as a "tapered" profile. Having the ability to selectively heat zones where necessary enables the operator to tailor and maintain a preselected temperature profile, ensuring desired productivity.

Each temperature sensor (not shown) is configured to monitor the temperature of the container during operation. The positioning of the two (2) bores 44 enables one (1) temperature sensor to be placed in the upper die end zone 72*d*, and one (1) temperature sensor to be placed in the lower die end zone 72*c*. Similarly, the positioning of the two (2) bores 46 enables one (1) temperature sensor to be placed in the right die end zone 72*g*, and one (1) temperature sensor to be placed in the left die end zone 72*h*. The positioning of the two (2) bores 48 enables one (1) temperature sensor to be placed in the upper ram end zone 72*f*, and one (1) temperature sensor to be placed in the lower ram end zone 72*e*. In this embodiment, the sensing elements are thermocouples. The temperature sensors feed into the controller, providing the operator with temperature data from which subsequent temperature adjustments can be made.

In use, the container 20 is oriented such that bores 44 are aligned generally vertically, and bores 46 are aligned generally horizontally. As will be appreciated, the positioning of temperature sensors in the mantle both above and below the liner 24 advantageously allows the vertical temperature profile across the liner 24 to be measured, and moreover allows any vertical temperature difference across the liner 24 that arises during extrusion to be directly monitored by the operator. The positioning of elongate heating elements both above and below the liner 24 advantageously allows any measured vertical temperature difference to be reduced or eliminated by increasing the thermal energy supplied by heating elements 70 positioned below the liner 24, or by reducing the thermal energy supplied by heating elements 70 above the liner 24, or by both.

Similarly, the positioning of temperature sensors in the mantle both right of and left of the liner 24 advantageously allows the horizontal temperature profile across the liner 24 to be measured, and moreover allows any horizontal temperature difference across the liner 24 that arises during extrusion to be directly monitored by the operator. The positioning of elongate heating elements both right of and left of the liner 24 advantageously allows any measured horizontal temperature difference to be reduced or eliminated by increasing the thermal energy supplied by heating elements 70 positioned on a first side of the liner 24, or by reducing the thermal energy supplied by heating elements 70 on a second side of the liner 24, or by both.

As each of the heating elements 70 are individually controllable, the thermal profile across the liner, and in turn the thermal profile within the container, can be accurately controlled. Those skilled in the art will appreciate that accurately controlling the thermal profile of the liner also allows the thermal profile of the extrusion die to be indirectly controlled, as the container and the extrusion die are in general thermal communication with each other by thermal conductance. As the temperature of the extrusion die affects the flow rate of extrudable material therethrough, control of the thermal profile within the container in turn allows the shape of the extruded product to be controlled for achieving a desired product shape.

Figure 8:
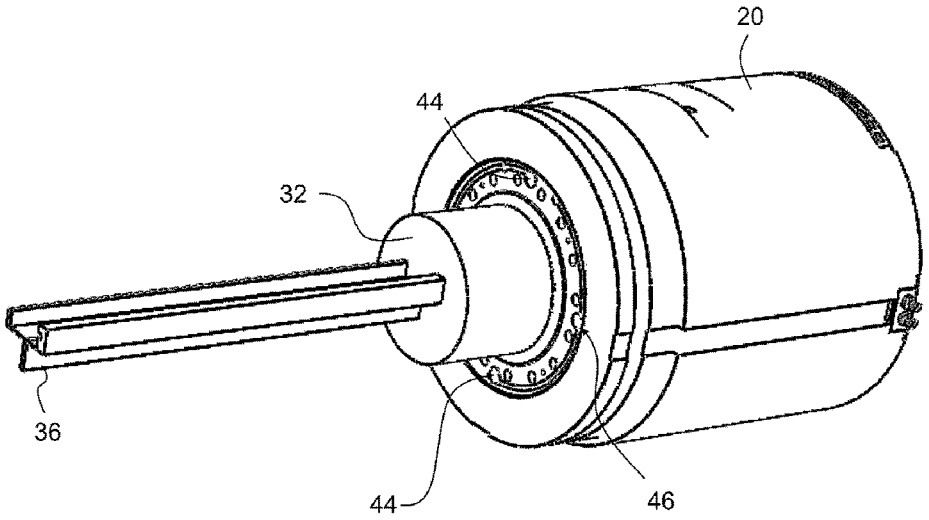
FIG. 8 is a perspective view of the container of FIG. 2 with an extrusion die mounted thereon, during use.

For example, FIG. 8 shows the container 20 and an extrusion die 32 mounted on the die end 34, during use. In the example shown, the extrusion die 32 defines a die aperture having a shape that includes thick, outer features connected by relatively thin web features. As will be appreciated, control of the horizontal and vertical temperature profiles across the liner, and therefore within the container, in turn allows the horizontal and vertical temperature profiles of the extrusion die to be controlled. As the temperature of the extrusion die affects the flow rate of extrudable material therethrough, control of the horizontal and vertical temperature profiles within the container in turn allows the shape of the extruded product 36 to be controlled for achieving a desired product shape.

It will be understood that the container is not limited to the configuration described above, and in other embodiments, the container may alternatively have other configurations. For example, although in the embodiment described above, the container is oriented such that one (1) of the bores 44 is positioned above the liner while the other bore 44 is positioned below the liner 24, and one (1) of the bores 46 is positioned on the right side of the liner while the other bore 46 is positioned on the left side of the liner, in other embodiments, the bores for accommodating temperature sensors may alternatively have a different orientation.

Although in the embodiment described above, the mantle comprises six (6) bores for accommodating temperature sensors, in other embodiments, the mantle may alternatively comprise additional or fewer bores for accommodating temperature sensors.

Although in the embodiment described above, the bores for accommodating temperature sensors extend partially into the length of the mantle, in other embodiments, the bores may alternatively extend the full length of the mantle. In related embodiments, the temperature sensors may alternatively be "cartridge" type temperature sensors, and may alternatively comprise a plurality of temperature sensing elements positioned along their length.

Although in the embodiment described above, the bores for accommodating temperature sensors extend into the mantle, in other embodiments, one or more of the bores for accommodating temperature sensors may further extend, or may alternatively extend, into the liner.

Although in the embodiment described above, the longitudinal bores for the elongate heating elements extend the length of the mantle, in other embodiments, the longitudinal bores for the elongate heating elements may alternatively extend only partially the length of the mantle. For example, in one embodiment, the longitudinal bores may alternatively extend from the ram end of the mantle to approximately one-half (0.5) inches from the die end of the mantle.

Although in the embodiment described above, the elongate heating elements are configured with die end heating sections and ram end heating sections, in other embodiments, the elongate heating elements may alternatively be configured with additional or fewer heating sections, and/or may alternatively be configured to heat along the entire length of the heating cartridge.

Although in the embodiment described above, the elongate heating elements in the vicinity of the lower die end zone and the lower ram end zone are described as being configured to be controlled by the operator to provide added temperature, it will be understood that these elongate heating elements are also configured to be controlled by the operator to provide reduced temperature. Similarly, although in the embodiment described above, the elongate heating elements in the vicinity of the upper die end zone and the upper ram end zone are described as being configured to be controlled by the operator to provide reduced temperature, it will be understood that these elongate heating elements are also configured to be controlled by the operator to provide added temperature.

Although embodiments have been described above with reference to the accompanying drawings, those of skill in the art will appreciate that variations and modifications may be made without departing from the scope thereof as defined by the appended claims.

What is claimed is:

1. A method of controlling a thermal profile within a metal extrusion press container, the metal extrusion press container comprising a mantle defining an outer portion of the metal extrusion press container and having an elongate axial bore therein, the bore having a first transverse axis orthogonal to a second transverse axis, the bore being sized to accommodate a liner having a longitudinally extending passage therein through which a billet is advanced, the bore having a surface for contacting the liner, the method comprising:

measuring vertical and horizontal thermal profiles across the liner using a first temperature sensor and a second temperature sensor positioned in the mantle on opposite sides of the first transverse axis, and a third temperature sensor and a fourth temperature sensor positioned in the mantle on opposite sides of the second transverse axis; and controlling the thermal profile in the container using a plurality of longitudinally extending heating elements accommodated by said mantle adjacent said bore;

wherein the plurality of temperature sensors are positioned in the mantle between the heating elements and the liner.

2. The method of claim 1, wherein measuring the thermal profile comprises:

measuring the vertical thermal profile within the container using said first and second temperature sensors, and measuring the horizontal thermal profile within the container using said third and fourth temperature sensors.

3. A container for use in a metal extrusion press, the container comprising:

a mantle defining an outer portion of the container having an elongate axial bore therein, the bore having a first transverse axis orthogonal to a second transverse axis, and a plurality of longitudinally extending heating elements accommodated by said mantle adjacent said bore, said heating elements being individually controllable for controlling a thermal profile within the container;

a liner accommodated within the bore and contacting the mantle, the liner comprising an elongate body having a longitudinally extending passage therein through which a billet is advanced; and a plurality of temperature sensors located in the mantle between the heating elements and the liner configured to measure vertical and horizontal thermal profiles across the liner, the plurality of temperature sensors comprising:

a first temperature sensor and a second temperature sensor positioned in the mantle on opposite sides of the first transverse axis; and a third temperature sensor and a fourth temperature sensor positioned in the mantle on opposite sides of the second transverse axis.

4. The container of claim 3, wherein said heating elements are arranged circumferentially about the axial bore of the mantle.

5. The container of claim 3, wherein said first, second, third and fourth temperature sensors are positioned adjacent a die end of the container.

6. The container of claim 3, wherein said first and second temperature sensors are configured to measure the vertical thermal profile within the container, and said third and fourth temperature sensors are configured to measure the horizontal thermal profile within the container.

7. The container of claim 3, wherein said temperature sensors are thermocouples.

8. The container of claim 3, wherein at least one of said heating elements comprises at least one heating section.

9. The container of claim 3, wherein each of said heating elements comprises two heating sections positioned towards each relative end thereof.

10. The container of claim 3, wherein the passage of the liner defines a surface for contacting the billet.

11. The container of claim 3, wherein the mantle defines an outermost portion of the container.

12. A mantle for a container for use in a metal extrusion press, the mantle defining an outer portion of the container, the mantle having:

an elongate axial bore, the bore having a first transverse axis orthogonal to a second transverse axis, the axial bore being sized to accommodate a liner having a longitudinally extending passage therein through which a billet is advanced, the axial bore having a surface for contacting the liner;

a plurality of longitudinally extending bores formed adjacent said axial bore and configured to accommodate heating elements;

a plurality of temperature sensor bores formed between the longitudinally extending bores and the axial bore and configured to accommodate temperature sensors, the temperature sensor bores comprising:

a first temperature sensor bore and a second temperature sensor bore formed in the mantle on opposite sides of the first transverse axis, and a third temperature sensor bore and a fourth temperature sensor bore formed in the mantle on opposite sides of the second transverse axis; and temperature sensors accommodated within the temperature sensor bores.

13. The mantle of claim 12, further comprising heating elements accommodated in said longitudinally extending bores, wherein the heating elements are individually controllable for controlling the thermal profile within the container.

14. The mantle of claim 12, wherein the temperature sensors are configured to measure the thermal profile within the container.

15. The mantle of claim 12, wherein the bores configured to accommodate said heating elements are formed circumferentially about the axial bore.

16. The mantle of claim 12, wherein said first, second, third and fourth temperature sensor bores are formed adjacent a die end of the mantle.

17. The mantle of claim 12, wherein said first and second temperature sensor bores are positioned to allow measurement of the vertical thermal profile within the container, and said third and fourth temperature sensor bores are positioned to allow measurement of the horizontal thermal profile within the container.

18. The mantle of claim 12, wherein said first, second, third and fourth temperature sensor bores terminate within the mantle.

* * * * *